US009163361B2

(12) United States Patent
Song et al.

(10) Patent No.: US 9,163,361 B2
(45) Date of Patent: Oct. 20, 2015

(54) WELDING STRUCTURE WITH DOUBLE-INCLINED SURFACE OF NO BUMPING AND NO VIBRATION SEAMLESS RAIL WITH HIGH LOAD-BEARING CAPABILITY

(75) Inventors: Yuquan Song, Jilin (CN); Minghui Wang, Jilin (CN); Xiaofang Guan, Jilin (CN)

(73) Assignee: Jilin University, Changchun, Jilin (CN)

( * ) Notice: Subject to any disclaimer, the term of this patent is extended or adjusted under 35 U.S.C. 154(b) by 163 days.

(21) Appl. No.: 13/876,415

(22) PCT Filed: Sep. 21, 2011

(86) PCT No.: PCT/CN2011/079922

§ 371 (c)(1), (2), (4) Date: Mar. 27, 2013

(87) PCT Pub. No.: WO2012/045260

PCT Pub. Date: Apr. 12, 2012

(65) Prior Publication Data

US 2013/0186968 A1 Jul. 25, 2013

(30) Foreign Application Priority Data

Oct. 4, 2010 (CN) ..... 2010 1 0503537

(51) Int. Cl.
*E01B 11/44* (2006.01)
*E01B 11/52* (2006.01)

(52) U.S. Cl.
CPC ..... *E01B 11/52* (2013.01); *E01B 11/44* (2013.01)

(58) Field of Classification Search
CPC ..... E01B 11/00; E01B 11/02; E01B 11/10; E01B 11/44; E01B 11/46; E01B 11/48; E01B 11/50; E01B 11/52
USPC ..... 238/151, 164, 175, 185, 186, 195
See application file for complete search history.

(56) References Cited

U.S. PATENT DOCUMENTS 3,942,579 A * 3/1976 Guntermann ..... 164/54

FOREIGN PATENT DOCUMENTS

| | | | | |
|---|---|---|---|---|
| CN | 101122110 | * | 2/2008 | ..... E01B 11/00 |
| CN | 101122110 | A | 2/2008 | |
| CN | 101698987 | A | 4/2010 | |
| CN | 101914880 | A | 12/2010 | |
| CN | 101967779 | A | 2/2011 | |
| JP | H09279502 | A | 10/1997 | |

* cited by examiner

*Primary Examiner* — R. J. McCarry, Jr.
(74) *Attorney, Agent, or Firm* — Reinhart Boerner Van Deuren P.C.

(57) ABSTRACT

A double inclined weld face structure for a jolt-and-vibration-free seamless rail with high bearing capacity relates to the welding of the seamless rail of the rail train, a weld seam of the rail according to the present application forms, at least partly, a double inclined weld face, forming an angle α with the vertical direction of the rail and an angle β with the transverse direction of the rail. The double inclined weld face can further improve the stress state in the weld face of the rail, enhance the bearing capacity of the weld face and eliminate upward and downward jolting and leftward and rightward shaking of a train. The double inclined weld faces of the two parallel rails (1) are arranged in a interleaving way and the interleaving length is greater than the length of a carriage, thus enhancing the running stability and durability of the train and more beneficial to use a simple existing Aluminothermic welding in the weld of the seamless rail.

12 Claims, 4 Drawing Sheets

WELDING STRUCTURE WITH DOUBLE-INCLINED SURFACE OF NO BUMPING AND NO VIBRATION SEAMLESS RAIL WITH HIGH LOAD-BEARING CAPABILITY

TECHNICAL FIELD

The present application relates to a spatial structure for weld faces of a seamless rail for a rail train, especially to a double inclined weld face structure for a jolt-and-vibration-free seamless rail with high bearing capacity.

TECHNICAL BACKGROUND

The Chinese applications serial No. 200910206270.7 and 201010250990.6 of the inventor for present application disclose solutions which enhance the tangential and axial bearing capacity. Just as can be seen from FIG. 8, the first application (No. 200910206270.7) designs a single inclined weld face 9 which is parallel to Axis y and inclines relative to Axis x with an angle α, so the upward and downward jolting of the train is eliminated, while the leftward and rightward shaking of the train can not be eliminated; as shown in FIG. 9, the second application (No. 201010250990.6) designs a inclined weld face 9 which is parallel to the Axis x and inclines relative to the axis y with an angle β, so the leftward and rightward shaking of the train is eliminate while its upward and downward jolting is not eliminated, this is not sufficiently to the steady, security and durability of the operation for a heavy-loaded high speed train. So a technical problem to be solved for the whole seamless welding of the rail is to design a double inclined weld face spatial structure where the upward and downward jolting and leftward and rightward shaking is eliminated.

SUMMARY

To solve the above technical problem, the present application provides a new double inclined weld face structure which not only enhances the tangential and axial bearing capacity of the weld face, but also eliminates the upward and downward jolting and leftward and rightward shaking of a train, and can effectively use Aluminothermic Welding processing.

The present application provides a jolt-and-vibration-free seamless rail which has high bearing capacity, comprising rails and weld seams for connecting the rails, characterized in that the weld seam at least includes a double inclined weld face $A_{\alpha\beta}$ formed on a rail head of the rail, the spatial relation between the double inclined weld face $A_{\alpha\beta}$ and the rail (1) is that a straight plane ABCD is a cross section $A_0$ perpendicular to a longitudinal axis z, and a inclined plane ABEG, which is a single inclined cross section $A_\alpha$, is achieved by rotating the straight plane ABCD an angle α about a vertical axis y, and an inclined cross section BEDH, which is a double inclined weld face $A_{\alpha\beta}$, is achieved by rotating the inclined cross section ABEG an angle β about BE edge; the angle α is formed between the double inclined weld face $A_{\alpha\beta}$ and an axis x, and the angle β is formed between the double inclined weld face $A_{\alpha\beta}$ and the vertical axis y.

Preferably, when $$\frac{\sigma_{0z}}{\tau_{0y}} = 1.5,\ \frac{\sigma_{0z}}{\tau_{0x}} = 2;\ \frac{\sigma_{0z}}{\tau_{0y}} = 2,\ \frac{\sigma_{0z}}{\tau_{0x}} = 2.2;$$

$$\text{or } \frac{\sigma_{0z}}{\tau_{0y}} = 2.4,\ \frac{\sigma_{0z}}{\tau_{0x}} = 2.5,$$

for the double inclined weld face $A_{\alpha\beta}$, the corresponding matching values of the angle α and β are selected from a group consisted of α=30°, β=30°; α=30°, β=45°; α=45°, β=30°; α=45°, β=45°; α=45°, β=60°; α=60°, β=45°; α=60°, β=30°; α=30°; β=60°; α=60°, β=60°; so that the shear stress applied on the plane $A_{\alpha\beta}$ is evidently reduced and the maximum bearing capacity of $A_{\alpha\beta}$ is enhanced, the rate of reduction of shear stress $\Delta\tau_x$ and $\Delta\tau_y$ are both greater than 100%, the reduction of normal stress $\Delta\sigma$ is greater than 35%, and the rate of increment of bearing capacity $\Delta F_x$, $\Delta F_y$, $\Delta F_z$ are all greater than 77%, $$\text{wherein } \Delta\tau_x = \frac{\tau_{0x} - \tau_{xh}}{\tau_{0x}},\ \Delta\tau_y = \frac{\tau_{0y} - \tau_{yh}}{\tau_{0y}},\ \Delta\sigma = \frac{\sigma_{0z} - \sigma_n}{\sigma_{0z}};$$

$$\Delta F_x = \frac{F_x - F_{0x}}{F_{0x}},\ \Delta F_y = \frac{F_y - F_{0y}}{F_{0y}},\ \Delta F_z = \frac{F_z - F_{0z}}{F_{0z}};$$

$\rho_{0z}$ is the allowable normal stress in z direction applied on the cross section $A_0$ perpendicular to the axis z, $\tau_{0y}$ and $\tau_{0x}$ are the allowable shear stress in y direction and in x direction applied on the $A_0$ respectively, $\tau_{xh}$ and $\tau_{yh}$ are the maximum shear stress in x direction and in y direction applied on the double inclined weld face $A_{\alpha\beta}$ respectively, $\sigma_n$ is the maximum normal stress applied on the surface $A_{\alpha\beta}$, and $F_{0x}$, $F_{0y}$, $F_{0z}$ are the maximum load in x, y, z direction applied on the surface $A_0$ respectively, $F_x$, $F_y$, $F_z$ are the maximum load applied on $A_{\alpha\beta}$ respectively.

Preferably, the double inclined weld face $A_{\alpha\beta}$ is formed on the whole cross section of the weld seam of the rail, which forms the angle α with the axis x and forms the angle β with the axis y, and a inclined weld seam (5) is formed on a rail tread of a rail head of the rail by intersection between the double inclined weld face $A_{\alpha\beta}$ and the rail tread of the rail head, and a inclined weld seam (7) is formed on a rail side surface of the rail head by intersection between the double inclined weld face $A_{\alpha\beta}$ and the rail side surface of the rail head.

Preferably, the weld seam of the rail includes the double inclined weld face $A_{\alpha\beta}$ formed on the rail head of the rail, and a single inclined cross section $A_{\alpha'}$, which forms an angle α' with the axis x, formed on a rail waist and a rail bottom of the rail, the single cross section $A_{\alpha'}$ intersects with the side surface of the rail waist and rail bottom to form a vertical weld seam.

Preferably, the weld seam of the rail includes the double inclined weld face $A_{\alpha\beta}$ formed on the rail head of the rail, and a single inclined cross section $A_{\beta'}$, which forms an angle β' with axis x, formed on the rail waist and rail bottom, the double inclined weld face $A_{\alpha\beta}$ intersects with the rail tread of the rail head to form a inclined weld seam and intersects with the side surface of the rail head to form a inclined weld seam, and the single inclined cross section $A_{\beta'}$ intersects with the side surface of the rail waist and rail bottom to form a inclined weld seam.

Preferably, the weld seam of the rail includes the double inclined weld face $A_{\alpha\beta}$ formed on the rail head of the rail, and an another double inclined weld face $A_{\alpha'\beta'}$ which forms an angle α' with the axis x and an angle β' with the axis y, formed on the rail waist and rail bottom, wherein α' is different from α, and β' is different from β.

Preferably, a wheel tread and a wheel rim of a wheel contact with the rail synchronously, i.e. the wheel tread (6) is leftward and rightward overlapped with the inclined weld seam (5) of the rail head tread formed by the double inclined weld face $A_{\alpha\beta}$, the corresponding wheel rim (8) is backward and forward overlapped with the inclined seam (7) of the side surface of the rail head formed by the double inclined weld face $A_{\alpha\beta}$.

Preferably, characterized in that the inclined weld faces on two parallel rails (1) are arranged in an interleaving way and the interleaving length is greater than the length of one carriage.

Preferably, the weld technique for the double inclined weld face is an Aluminothermic welding.

The beneficial effect of the application is that (a) the upward and downward jolting, and the leftward and rightward shaking are eliminated simultaneously when the train passes through the inclined weld seam of the double inclined weld seam.

(b) the pure shear stress in the vertical and transverse direction of the rail's double inclined weld face and the pure normal tension stress in the rail moving direction are all reduced.

(c) the bearing capacity in the transverse, vertical and axial direction of the rail are all enhanced.

(d) the double inclined weld faces of the two parallel rails are arranged in a back and front interleaving arrangement to increase the security of the train operation.

(e) since the pure normal tension stress and the pure shear stress are reduced, and the transverse, vertical, and axial bearing capacity are enhanced because of the double inclined weld face, the reliability of the double inclined weld face may be assured by using the Aluminothermic welding, which may raise the welding efficiency, simply the welding technique, reduce the welding cost and may be welded in the workshop or online welding.

(f) it is particularly applying to the welding of the rail belonging to the heavy load train and the high speed multiple motor train units.

In generally, the present application can not only enhance the bearing capacity of the double inclined weld face, reduce the axial tension stress and the transverse shear stress of the double inclined weld face, and simultaneously eliminate the unward and downward jolting and leftward and rightward shaking of the train, furthermore, the Aluminothermic welding may be effective used in the welding of the seamless rail, which is an important revolution for the rail's seamless welding in the railroading, especially applied to the rail's whole seamless welding of the heavy load, high speed train.

BRIEF DESCRIPTION OF THE DRAWINGS

FIG. 5(*b*) is a schematic view showing a double inclined weld face $A_{\alpha\beta}$ formed on the rail head and a single inclined welding surface $A_{\alpha'}$ formed on the rail waist and rail bottom;

EMBODIMENTS

Figure 1:
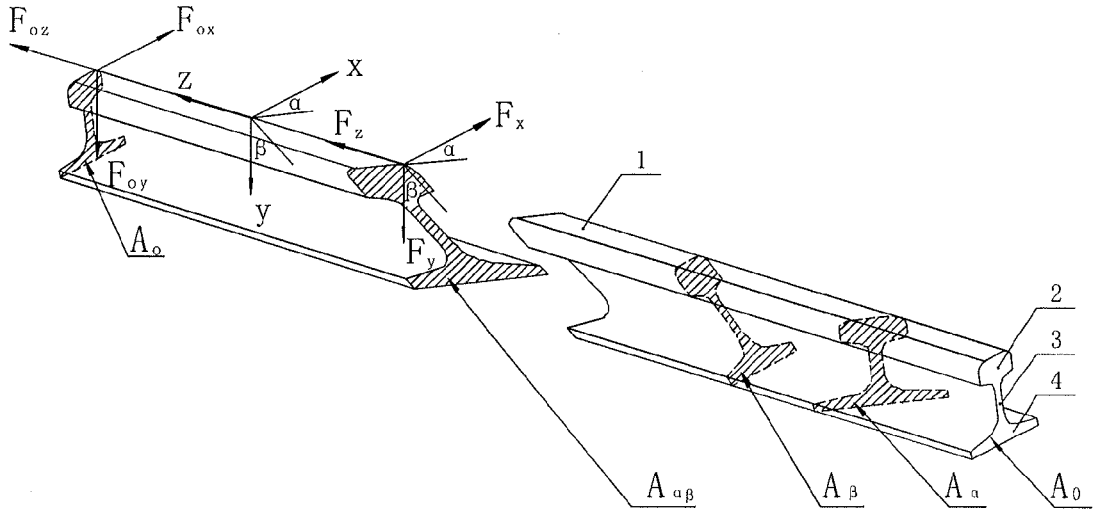
FIG. 1 is a schematic view of the spatial direction of the double inclined weld face $A_{\alpha\beta}$.

The weld face structure of the seamless rail according to the present application includes a rail and weld seams, as shown in FIG. 1, a weld seam of rail 1 is formed by a double inclined weld face $A_{\alpha\beta}$ intersecting with the rail 1, wherein in the xyz coordinate system, the longitudinal axis z extends along the longitudinal direction of the rail, the vertical axis y extends downward perpendicular to the longitudinal axis z of the rail, and the transverse axis x extends inward perpendicular to the z direction of the rail. In FIG. 1, the cross section $A_0$ is a cross section perpendicular to the axis z, an inclined surface $A_\alpha$ is an inclined surface forming an angle α with the transverse axis x, and an inclined surface $A_\beta$ is an inclined surface forming an angle) β with the perpendicular axis y. The rail 1 includes a rail head 2, a rail waist 3 and a rail bottom 4 that form an section with I beam shape.

1. The Spatial Relation Between the Double Inclined Weld Face $A_{\alpha\beta}$ and the Rail 1

As shown in FIG. 1, $A_{\alpha\beta}$ is a double inclined weld face which forms an angle α with the transverse axis x and an angle β with the perpendicular axis y.

Figure 2:
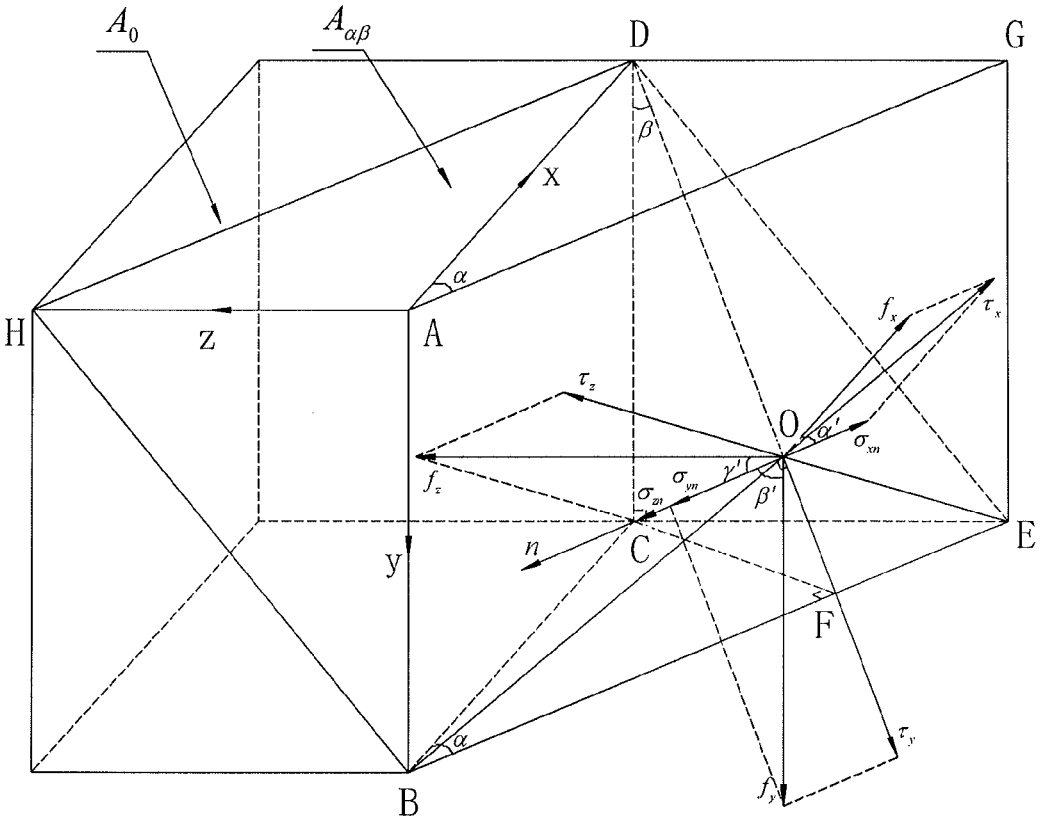
FIG. 2 is a formation and stress state view of the double inclined weld face $A_{\alpha\beta}$.

The configuration of the double inclined weld face $A_{\alpha\beta}$: the spatial relations of the double inclined weld face $A_{\alpha\beta}$ is as shown in FIG. 2, a weld face ABCD is a cross section $A_0$ perpendicular to the axis z, the surface ABCD rotates an angle α around the axis x to obtain a inclined surface ABEG, then the inclined surface ABEG rotates an angle β around BE to obtain a inclined surface BEDH, i.e. the double inclined weld face $A_{\alpha\beta}$, which forms an angle α with the axis x, and an angle β with the axis y. n is the normal vector of the double inclined weld face BEDH, which forms an angle (π−α') with the axis x, and forms angles β', γ' with the axis y and axis z respectively. Wherein, α=∠CBE, β=∠CDF, α'=∠OCB, β'=∠OCD, γ'=∠OCE;

2. The Trigonometric Functions Relations of the Double Inclined Surface

According to FIG. 2:

$$CF = BC\cdot\sin\alpha,\ CE = CF/\cos\alpha,\ BF = BC\cdot\cos\alpha,\quad (1)$$
$$OF = CF\cdot\sin\beta = BC\cdot\sin\alpha\cdot\sin\beta,$$
$$EF = CF\cdot tg\alpha = BC\cdot\sin\alpha\cdot tg\alpha,$$
$$OC = CF\cdot\cos\beta = BC\cdot\sin\alpha\cdot\cos\beta$$

$$\angle BOF = arctg\frac{BF}{OF} = arctg\frac{BC\cdot\cos\alpha}{BC\cdot\sin\alpha\cdot\sin\beta} = arctg\frac{\cos\alpha}{\sin\alpha\cdot\sin\beta},$$

$$\angle EOF = arctg\frac{EF}{OF} = arctg\frac{BC\cdot\sin\alpha\cdot tg\alpha}{BC\cdot\sin\alpha\cdot\sin\beta} = arctg\frac{tg\alpha}{\sin\beta}\circ$$

then $$\cos(\pi-\alpha') = -\cos\alpha' = -\frac{OC}{BC} = -\sin\alpha\cos\beta$$

$$\sin\alpha' = \sqrt{1-\cos^2\alpha'} = \sqrt{1-\sin^2\alpha\cdot\cos^2\beta}\quad (2)$$

$$\cos\beta' = \cos\left(\frac{\pi}{2}-\beta\right) = \sin\beta\quad (3)$$

$$\sin\beta' = \sqrt{1-\cos^2\beta'} = \sqrt{1-\sin^2\beta} = \cos\beta\quad (4)$$

-continued $$\cos\gamma' = \frac{OC}{CE} = \frac{CF\cdot\cos\beta}{\frac{CF}{\cos\alpha}} = \cos\alpha\cdot\cos\beta \tag{5}$$

$$\sin\gamma' = \sqrt{1-\cos^2\gamma'} = \sqrt{1-\cos^2\alpha\cdot\cos^2\beta} \tag{6}$$

$$\cos\angle BOF = \frac{\sin\alpha\sin\beta}{\sqrt{1-\sin^2\alpha\cos^2\beta}} \tag{7}$$

$$\sin\angle BOF = \frac{\cos\alpha}{\sqrt{1-\sin^2\alpha\cos^2\beta}} \tag{8}$$

$$\cos\angle EOF = \frac{\cos\alpha\sin\beta}{\sqrt{1-\cos^2\alpha\cos^2\beta}} \tag{9}$$

$$\sin\angle EOF = \frac{\sin\alpha}{\sqrt{1-\cos^2\alpha\cos^2\beta}} \tag{10}$$

3. The Stress Analysis of the Double Inclined Weld Face

As shown in FIGS. 1 and 2, $F_z$ is a pulling force applied on the surface $A_{\alpha\beta}$ in a travel direction of the train, and $F_y$ is a vertical load on the surface $A_{\alpha\beta}$ applied by the train, and F is a transverse load on the surface $A_{\alpha\beta}$ applied by the wheel rim, since the normal stress in the z direction applied on the surface $A_0$ is $\sigma_{0z}=F_{0z}/A_0$, and the shear stress in the x direction and y direction applied on the surface $A_0$ respectively are $\tau_{0x}=F_{0x}/A_0$ and $\tau_{0y}=F_{0y}/A_0$, wherein $F_{0x}$, $F_{0y}$, $F_{0z}$ are the maximum loads, $\tau_{0x}$ and $\tau_{0y}$ are the maximum shear stress in the surface $A_0$ $\sigma_{0z}$ is the maximum tension stress in the surface $A_0$. So $F_{0x}=A_0\tau_{0x}$, $F_{0y}=A_0\tau_{0y}$, $F_{0z}=A_0\sigma_{0z}$. It is more beneficial to the reliability of the analysis, if $\tau_{0x}$, $\tau_{0y}$ and $\sigma_{0z}$ are defined as the allowable stresses.

The stresses applied on the double inclined surface $A_{\alpha\beta}$ are $f_x=F_x/A_{\alpha\beta}$, $f_y=F_y/A_{\alpha\beta}$, $f_z=F_z/A_{\alpha\beta}$ respectively. From $A_0=A_{\alpha\beta}\cos\gamma'$ and $\cos\gamma'=\cos\alpha\cos\beta$, We will achieved $$A_0=A_{\alpha\beta}\cos\alpha\cdot\cos\beta \tag{11}$$

Since $F_z=F_{0z}$ $F=F_{0y}$, $F=F_{0x}$, from FIG. 1 and the equation (11), we will obtain following:

$$f_z = \frac{F_z}{A_0}\cos\alpha\cos\beta = \sigma_{0z}\cos\alpha\cos\beta,$$

$$f_y = \frac{F_y}{A_0}\cos\alpha\cos\beta = \tau_{0y}\cos\alpha\cos\beta,$$

$$f_x = \frac{F_x}{A_0}\cos\alpha\cos\beta = \tau_{0x}\cos\alpha\cos\beta.$$

3.1 A Resultant Stress of the Normal Stress

According to FIG. 2, $\sigma_{zn}=f_z\cdot\cos\gamma'$, $\sigma_{xn}=f_x\cdot\cos\alpha'$ and $\sigma_{yn}=f_y\cdot\cos\beta'$ applied on the surface $A_{\alpha\beta}$ are all the normal stress. So the resultant normal stress applied on the surface $A_{\alpha\beta}$ is $\sigma_h=\sigma_{zn}+\sigma_{yn}-\sigma_{xn}$. So it is obtained, $$\sigma_h=f_z\cdot\cos\gamma'+f_y\cdot\cos\beta'-f_x\cdot\cos\alpha'$$

The equations (1), (3), (5) are substituted in and solved, then it is obtained, $$\sigma_h=\sigma_{0z}\cdot\cos^2\alpha\cos^2\beta+\tau_{0y}\cdot\cos\alpha\sin\beta\cos\beta-\tau_{0x}\cdot\sin\alpha\cos\alpha\cos^2\beta \tag{12}$$

3.2 A Resultant Stress of the Shear Stress

Figure 3:
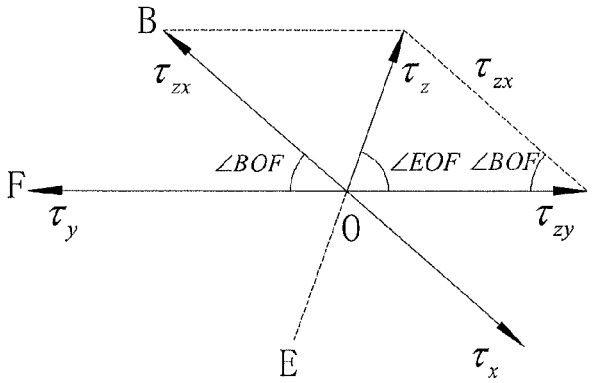
FIG. 3 is a shear stress diagram of the double inclined weld face $A_{\alpha\beta}$.

It is obtained from FIG. 2 that $f_x$, $f_y$, $f_z$ and the shear stress applied on the surface $A_{\alpha\beta}$ respectively are $\tau_x$, $\tau_y$, $\tau_z$, wherein the shear stress $\tau_x$, $\tau_y$, $\tau_z$ must be orthogonal to the normal line n and settled down on the surface $A_{\alpha\beta}$. Thus $\tau_x=f_x\sin\alpha'$, $\tau_y=f_y\sin\beta'$ and $\tau_z=f_z\sin\gamma'$. And because $\tau_x$, $\tau_y$, $\tau_z$ are settled down on the surface $A_{\alpha\beta}$, so $\tau_x$ is equidirectional with BO, $\tau_y$ is equidirectional with OF, and $\tau_z$ is equidirectional with EO. Since the x directional shear stress and the y directional resultant shear stress are concerned, the shear stress $\tau_z$ should be resolved to an x directional shear stress $\tau_{zx}$ and a y directional shear stress $\tau_{zy}$, and the view showing the resolve of the shear stress corresponding to FIG. 2 is shown in FIG. 3. It is obtained from the sine rule $$\frac{\tau_z}{\sin\angle BOF} = \frac{\tau_{zx}}{\sin\angle EOF} = \frac{\tau_{zy}}{\sin(\pi-\angle BOF-\angle EOF)}$$

Thus, $\tau_{zx}=\tau_z\sin\angle EOF/\sin\angle BOF$; $\tau_{zy}=\tau_z\cos\angle EOF+\tau_z\sin\angle EOF\mathrm{ctg}\angle BOF$ So, the resultant stress $\tau_{xh}$ of the x directional shear stress $$\tau_{xh} = \tau_x - \tau_{zx} = \tau_x - \frac{\tau_z\sin\angle EOF}{\sin\angle BOF} \tag{13}$$

equations (8), (10) are substituted in equation (13) and neutralized, it is obtained $$\tau_{xh}=(\tau_{0x}\cdot\cos\alpha\cos\beta-\tau_{0z}\cdot\sin\alpha\cos\beta)\sqrt{1-\sin^2\alpha\cos^2\beta} \tag{14}$$

the resultant stress $\tau_{yh}$ of the y directional shear stress $$\tau_{yh}=\tau_y-\tau_{zy}=\tau_y-\tau_z(\cos\angle EOF+\sin\angle EOF\mathrm{ctg}\angle BOF) \tag{15}$$

equations (7)-(10) are substituted in equation (15) and neutralized, it is obtained $$\tau_{yh}=\tau_{0y}\cdot\cos\alpha\cos^2\beta-\sigma_{0z}\cdot\sin\beta\cos\beta \tag{16}$$

3.3 The Reduction of the Stress of the Double Inclined Weld Face

Compared with the normal stress $\sigma_{0z}$ and the shear stress $\tau_{0x}$, $\tau_{0y}$, applied on the surface $A_0$, the reduction of the normal stress $\sigma_h$ and the shear stress $\tau_{xh}$, $\tau_{yh}$ applied on the surface $A_{\alpha\beta}$ are $\Delta\sigma$ and $\Delta\tau_x$, $\Delta\tau_y$, which may be obtained from equations (12), (14) and (16)

$$\Delta\sigma = \frac{\sigma_{0z}-\sigma_n}{\sigma_{0z}} = 1-\cos^2\alpha\cos^2\beta-\frac{\tau_{0y}}{\sigma_{0z}}\cos\alpha\sin\beta\cos\beta+\frac{\tau_{0x}}{\sigma_{0z}}\sin\alpha\cos\alpha\cos^2\beta \tag{17}$$

$$\Delta\tau_x = \frac{\tau_{0x}-\tau_{xh}}{\tau_{0x}} = 1-\left(\cos\alpha\cos\beta-\frac{\sigma_{0z}}{\tau_{0x}}\sin\beta\cos\beta\right)\sqrt{1-\sin^2\alpha\cos^2\beta} \tag{18}$$

$$\Delta\tau_y = \frac{\tau_{0y}-\tau_{yh}}{\tau_{0y}} = 1-\cos\alpha\cos^2\beta+\frac{\sigma_{0z}}{\tau_{0x}}\sin\beta\cos\beta \tag{19}$$

Figure 4:
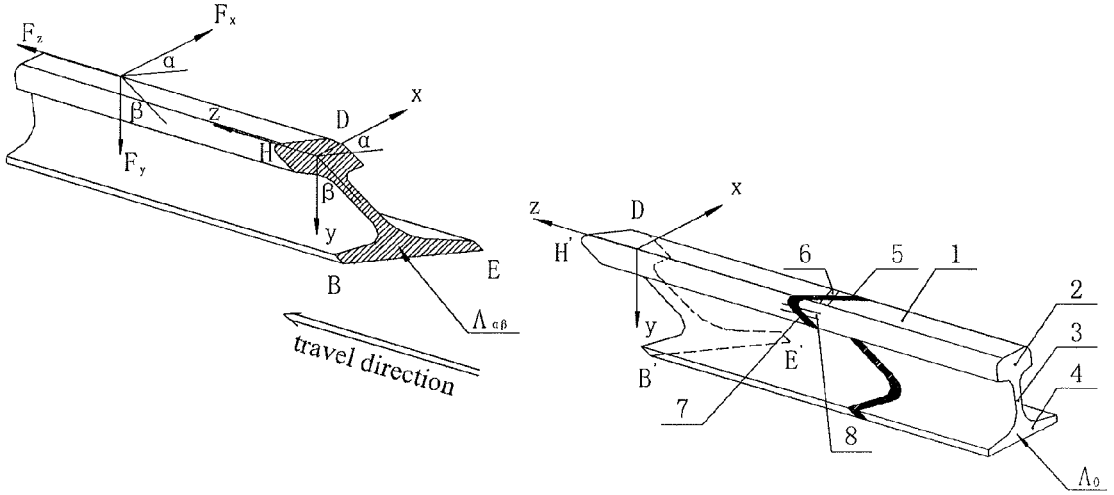
FIG. 4 is a schematic view of the steady operation when the wheel tread passes through inclined weld seams on the rail tread of the rail head and the wheel rim passes through the inclined seam on the side surface of the rail head.

4. The Enhance of the Steady Property in Operation and the Bearing Capacity 4.1 The Steady Property for Operation The relations between the double inclined weld seams on the rail tread of the rail head and the side surface of the rail head applied by the wheel in travel direction of train is shown in FIG. 4. When the train passes through a inclined weld face seam which forms an angle α with the axis x, the wheel tread 6 does not completely contact with the inclined seam 5 of the rail head, but contacts with an inner and outer parts of the inclined weld seam 5 in an overlapped way, so the axle weight is shared by the inner and outer parts of the rail head. When the train passes through a inclined weld seam which forms an angle β with the axis y, the wheel rim 8 does not completely contact with the inclined weld seam 7 of the side surface of the rail head, but contacts with a front and back parts of the inclined weld seam 7 in an overlapped way, so the axle weight is shared by the front and back parts of the rail head. Thus it is simultaneously eliminated the upward and downward jolting and leftward and rightward shaking resulted by the seam sinking. So the steady property in operation of the train is further enhanced than that of the single inclined weld face.

4.2 The Enhancement of the Bearing Capacity

The maximum loads in z direction, y direction and x direction applied on the surface $A_0$ are $F_{0z}$, $F_{0y}$, $F_{0x}$, and $F_{0z}=A_0\cdot\sigma_{0z}$, $F_{0y}=A_0\cdot\tau_{0y}$, $F_{0x}=A_0\cdot\tau_{0x}$, wherein $\sigma_{0z}$, $\tau_{0y}$ and $\tau_{0x}$ are the allowable stress applied on the surface $A_0$. The maximum loads in z direction, y direction and x direction applied on the $A_{\alpha\beta}$ are $F_z$, $F_y$, $F_x$, so the normal load of $F_z$ resolved onto the surface $A_{\alpha\beta}$ is $F_{\alpha\beta n}=F_z\cos\gamma'$, and the load in y direction of $F_y$ resolved onto the surface $A_{\alpha\beta}$ is $F_{\alpha\beta y}=F_y\cos\beta'$, and the load in x direction of $F_x$ resolved onto the surface $A_{\alpha\beta}$ is $F_{\alpha\beta x}=F_x\cos\alpha'$ and $F_{\alpha\beta n}=A_{\alpha\beta}\cdot\sigma_{\alpha\beta n}$, $F_{\alpha\beta y}=A_{\alpha\beta}\cdot\tau_{\alpha\beta y}$, $F_{\alpha\beta x}=A_{\alpha\beta}\cdot\tau_{\alpha\beta x}$, the allowable stress $\sigma_{0z}$, $\tau_{0y}$, $\tau_{0x}$ instead of $\sigma_{\alpha\beta n}$, $\tau_{\alpha\beta y}$, $\tau_{\alpha\beta x}$ is also allowable for the comparability of the analysis, so $F_{\alpha\beta n}=\sigma_{0z}\cdot A_{\alpha\beta}$, $F_{\alpha\beta y}=\tau_{0y}\cdot A_{\alpha\beta}$, $F_{\alpha\beta x}=\tau_{0x}\cdot A_{\alpha\beta}$. Thus with respect to the maximum z directional load $F_{0z}$ applied on the surface $A_0$, the enhance of the z directional bearing capacity applied on the surface $A_{\alpha\beta}$ is $$\Delta F_z = \frac{F_z - F_{0z}}{F_{0z}} = \frac{F_{\alpha\beta n}/\cos\gamma'}{F_{0z}} - 1 = \frac{A_{\alpha\beta}\cdot\sigma_{0z}/\cos\gamma'}{A_0\cdot\sigma_{0z}} - 1 = \frac{1}{\cos^2\gamma'} - 1 \tag{20}$$

with respect to the maximum y directional load $F_{0y}$ applied on the surface $A_0$, the enhance of the y directional bearing capacity applied on the surface $A_{\alpha\beta}$ is $$\Delta F_y = \frac{F_y - F_{0y}}{F_{0y}} = \frac{F_{\alpha\beta y}/\cos\beta'}{F_{0y}} - 1 = \frac{1}{\cos\beta'\cos\gamma'} - 1 \tag{21}$$

with respect to the maximum x directional load $F_{0x}$ applied on the surface $A_0$, the enhance of the x directional bearing capacity applied on the surface $A_{\alpha\beta}$ is $$\Delta F_x = \frac{F_x - F_{0x}}{F_{0x}} = \frac{1}{\cos\alpha'\cos\gamma'} - 1 \tag{22}$$

equations (1), (3), (5) are correspondingly substituted in equations (20), (21), (22), then $$\Delta F_z = \frac{1}{\cos^2\alpha\cdot\cos^2\beta} - 1 \tag{23}$$

$$\Delta F_y = \frac{1}{\cos\alpha\cdot\sin\beta\cos\beta} - 1 \tag{24}$$

$$\Delta F_x = \frac{1}{\sin\alpha\cos\alpha\cdot\cos^2\beta} - 1 \tag{25}$$

A practical example according to the present application "A double inclined weld face structure for a jolt-and-vibration-free seamless rail with high bearing capacity" is shown in the following.

In practice, the subgrade is an existing reinforced concrete ballastless subgrade, and the rail is all models of rail used by an actual heavy load, high speed passenger train and city rail train, while a rail sleeper, rails tie plate, rails tie plate mounting bolt and fastening by which the rails connect to the subgrade, are exactly the same.

Because the surface $A_{\alpha\beta}$ is determined after the angles $\alpha$ and $\beta$ of the double inclined surface are determined, and if the reduction of the normal tension stress $\Delta\sigma$, the reduction of the pure shear stress $\Delta\tau_x$ and $\Delta\tau_y$ comply with the design requirements, the angles $\alpha$ and $\beta$ of the double inclined surface $A_{\alpha\beta}$ are determined. And because the analysis formula (17)~(19) for the reduction of the stress applied on the surface $A_{\alpha\beta}$ by the load include backlog items $$\left(\frac{\sigma_{0z}}{\tau_{0x}}\right) \text{ and } \left(\frac{\sigma_{0z}}{\tau_{0y}}\right),$$

if $$\left(\frac{\sigma_{0z}}{\tau_{0x}}\right) \text{ and } \left(\frac{\sigma_{0z}}{\tau_{0y}}\right)$$

are known, $\Delta\sigma$, $\Delta\tau_x$, $\Delta\tau_y$ corresponding to $\alpha$, $\beta$ could be obtained. Because in operation of the train, the z directional maximum trailing load $F_z$ applied on the surface $A_{\alpha\beta}$ is greater than the y directional maximum normal positive compressive loading of the wheel $F_y$ which is greater than the maximum transverse load $F_x$ applied on the surface $A_{\alpha\beta}$ by the wheel rim, so there is a relation among the maximum stress $\sigma_{0z}$, $\tau_{0x}$ and $\tau_{0y}$: $\sigma_{0z}>\tau_{0y}>\tau_{0x}$. According to the relation $\sigma_{0z}>\tau_{0y}>\tau_{0x}$, after $$\frac{\sigma_{0z}}{\tau_{0y}} = 1.5,\ \frac{\sigma_{0z}}{\tau_{0x}} = 2;\ \frac{\sigma_{0z}}{\tau_{0y}} = 2,\ \frac{\sigma_{0z}}{\tau_{0x}} = 2.2;\ \frac{\sigma_{0z}}{\tau_{0y}} = 2.4,\ \frac{\sigma_{0z}}{\tau_{0x}} = 2.5$$

are determined, the stress reduction corresponding to the angles $\alpha$, $\beta$ will be obtained, which are listed in table 1, 2 and 3. The enhancement of the bearing capacity corresponding to the angles $\alpha$, $\beta$ are listed in table 4.

According to the actual operation of different types of train, the values of $$\left(\frac{\sigma_{0z}}{\tau_{0y}}\right) \text{ and } \left(\frac{\sigma_{0z}}{\tau_{0x}}\right)$$

are determined, then according to the reduction $\Delta\sigma$, $\Delta\tau_y$, $\Delta\tau_x$ of the design requirements, the design values of angles $\alpha$ and $\beta$ on the surface $A_{\alpha\beta}$ are determined. After the angles $\alpha$ and $\beta$ are determined, the rail heads of two tracks to be welded are sawed into the double inclined surface $A_{\alpha\beta}$ by a belt saw or non-tooth saw, then aligned with each other up and down, and set aside a suitable clearance, welded by the Aluminothermic welding, and then project, polish, and heat treatment, that is to say, the welding of the double inclined surface is finished.

TABLE 1 the stress reduction at $\frac{\sigma_{0z}}{\tau_{0y}} = 1.5$, $\frac{\sigma_{0z}}{\tau_{0x}} = 2$

| angle | Inclined surface's | | | | | | | | | | | | | | | | | |
|---|---|---|---|---|---|---|---|---|---|---|---|---|---|---|---|---|---|---|
| Stress reduction (%) | α 30° | β 30° | α 30° | β 45° | α 45° | β 30° | α 45° | β 45° | α 45° | β 60° | α 60° | β 45° | α 60° | β 30° | α 30° | β 60° | α 60° | β 60° |
| Δσ | 35.0 | | 44.5 | | 60.8 | | 70.3 | | 73.3 | | 81.7 | | 83.1 | | 61.7 | | 84.7 | |
| $\Delta\tau_y$ | 100.0 | | 131.7 | | 111.9 | | 184.6 | | 147.3 | | 150.0 | | 127.5 | | 143.3 | | 152.5 | |
| $\Delta\tau_x$ | 110.5 | | 108.9 | | 148.4 | | 165.0 | | 133.1 | | 168.9 | | 170.6 | | 106.5 | | 155.5 | |

TABLE 2 stress reduction at $\frac{\sigma_{0z}}{\tau_{0y}} = 2$, $\frac{\sigma_{0z}}{\tau_{0x}} = 2.2$

| | Inclined surface's angle | | | | | | | | | | | | | | | | | |
|---|---|---|---|---|---|---|---|---|---|---|---|---|---|---|---|---|---|---|
| Stress Reduction (%) | α 30° | β 30° | α 30° | β 45° | α 45° | β 30° | α 45° | β 45° | α 45° | β 60° | α 60° | β 45° | α 60° | β 30° | α 30° | β 60° | α 60° | β 60° |
| Δσ | 39.8 | | 50.7 | | 64.2 | | 68.7 | | 77.9 | | 84.8 | | 85.2 | | 67.4 | | 87.8 | |
| $\Delta\tau_y$ | 121.7 | | 156.7 | | 133.6 | | 164.6 | | 168.9 | | 175.0 | | 149.1 | | 165.0 | | 174.1 | |
| $\Delta\tau_x$ | 118.3 | | 115.5 | | 158.1 | | 152.0 | | 139.7 | | 178.6 | | 180.5 | | 111.3 | | 163.3 | |

TABLE 3 stress reduction at $\frac{\sigma_{0z}}{\tau_{0y}} = 2.4$, $\frac{\sigma_{0z}}{\tau_{0x}} = 2.5$

| angle | Inclined surface's | | | | | | | | | | | | | | | | | |
|---|---|---|---|---|---|---|---|---|---|---|---|---|---|---|---|---|---|---|
| Stress reduction (%) | α 30° | β 30° | α 30° | β 45° | α 45° | β 30° | α 45° | β 45° | α 45° | β 60° | α 60° | β 45° | α 60° | β 30° | α 30° | β 60° | α 60° | β 60° |
| Δσ | 41.1 | | 53.1 | | 64.7 | | 70.3 | | 79.7 | | 85.7 | | 85.2 | | 70.0 | | 89.1 | |
| $\Delta\tau_y$ | 139.0 | | 176.7 | | 150.9 | | 184.6 | | 186.2 | | 195.0 | | 166.4 | | 182.3 | | 191.4 | |
| $\Delta\tau_x$ | 130.0 | | 125.4 | | 172.6 | | 165.0 | | 149.6 | | 193.1 | | 195.4 | | 118.6 | | 175.0 | |

TABLE 4 enhance of the bearing capacity corresponding to the angle α, β

| Increment rate of the bearing | Inclined surface's angle | | | | | | | | | | | | | | | | | |
|---|---|---|---|---|---|---|---|---|---|---|---|---|---|---|---|---|---|---|
| capacity (%) | α 30° | β 30° | α 30° | β 45° | α 45° | β 30° | α 45° | β 45° | α 45° | β 60° | α 60° | β 45° | α 60° | β 30° | α 30° | β 60° | α 60° | β 60° |
| $\Delta F_z$ | 77.8 | | 166.7 | | 166.7 | | 300 | | 700 | | 700 | | 433.3 | | 433.3 | | 1500 | |
| $\Delta F_y$ | 166.7 | | 130.9 | | 226.6 | | 182.8 | | 226.6 | | 300 | | 361.9 | | 166.7 | | 361.9 | |
| $\Delta F_x$ | 207.9 | | 361.9 | | 166.7 | | 300 | | 700 | | 361.9 | | 207.9 | | 823.8 | | 823.8 | |

From tables 1, 2 and 3, we can see that the reduction of the shear stress $\Delta\tau_x$ and $\Delta\tau_y$ are greater than 100%. It seems to difficult to understand at first sight, but it will be clear after analyzing the FIG. 3 of the shear stress: because $\tau_{zx}$ and $\tau_{zy}$ are the resolved shear stress of $\tau_z$ in x and y direction and those directions are opposed to the direction of $\tau_x$ and $\tau_y$, when the absolute values of $\tau_{zx}$ and $\tau_x$ are equal to each other and the absolute values of $\tau_{zy}$ and $\tau_y$ are equal to each other too, the reduction $\Delta\tau_x$ and $\Delta\tau_y$ are equal to 100%; when the absolute values of $\tau_{zx}$ and $\tau_{zy}$ are greater than that of $\tau_x$ and $\tau_y$, the reduction $\Delta\tau_x$ and $\Delta\tau_y$ are greater than 100%. But the reduction of $\Delta\tau_x$ and $\Delta\tau_y$ are not allowed to be greater than 200%. From FIG. 2, we can see that the normal stress $\sigma_{zn}$ is impossible to be greater than $\sigma_{xn}+\sigma_{yn}$, so the reduction of $\Delta\sigma$ is impossible to be greater than 100%, seeing FIG. 2.

Figure 5:
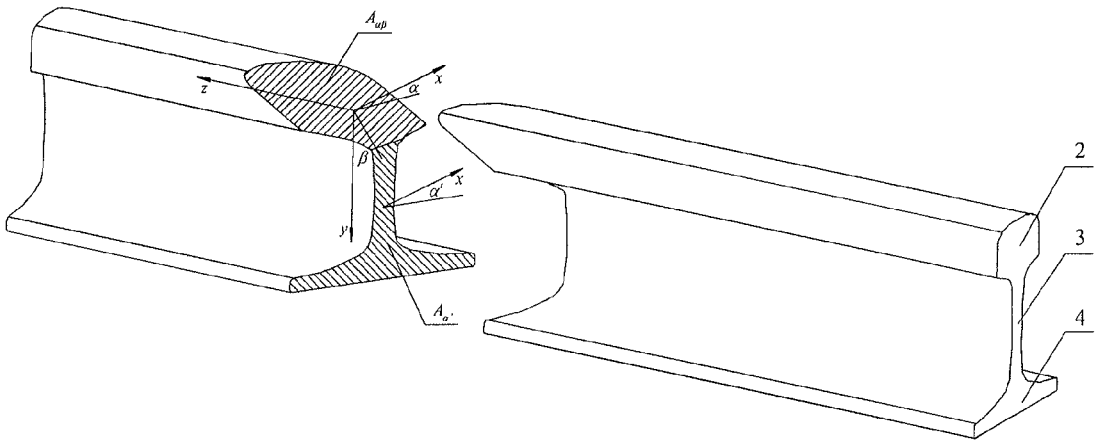
FIG. 5(*a*) is a schematic view showing a double inclined weld face $A_{\alpha\beta}$ formed on the rail head and a single inclined welding surface $A_{\alpha'}$ formed on the rail waist and rail bottom.
Figure 5:
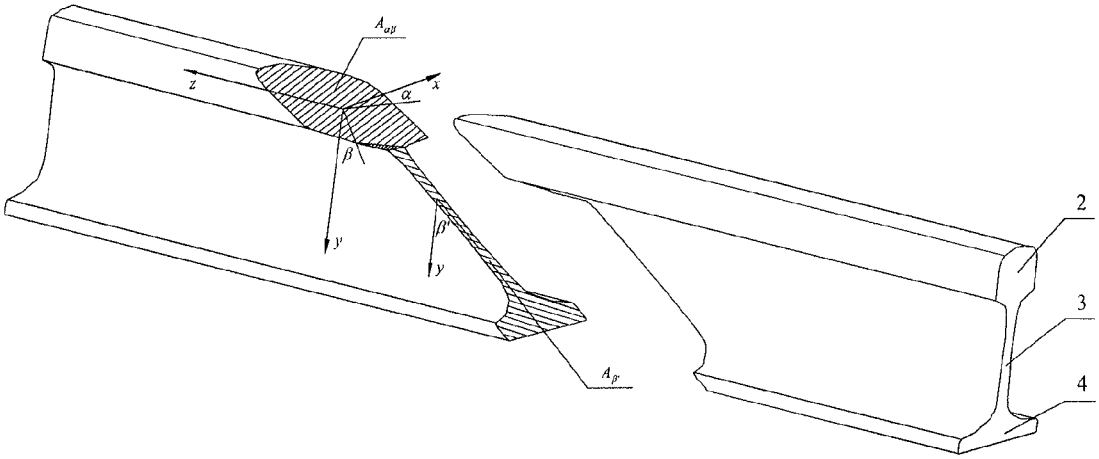
Figure 6:
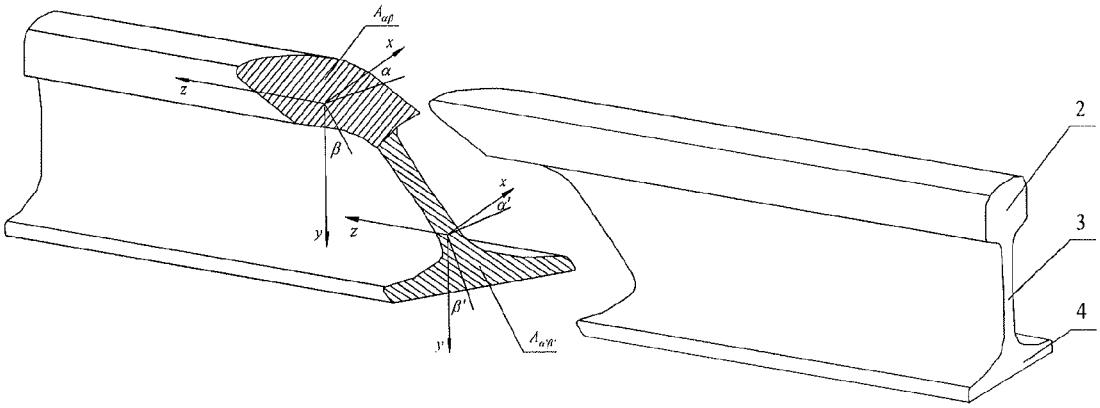
FIG. 6 is a schematic view showing a double inclined weld face $A_{\alpha\beta}$ formed on the rail head and an another double inclined welding surface $A_{\beta'}$ formed on the rail waist and rail bottom.
Figure 7:
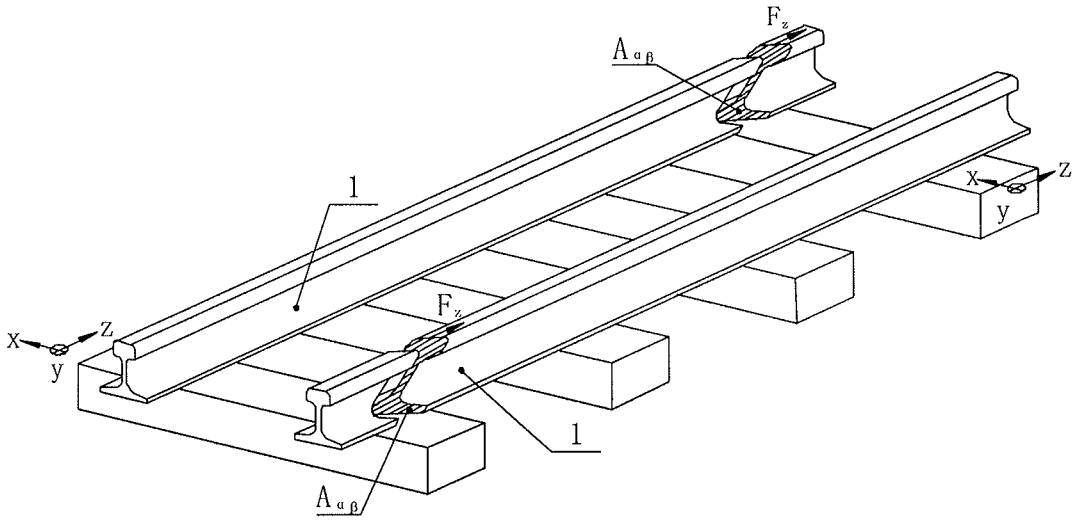
FIG. 7 is a view showing the arrangement in a interleaving way of the double inclined weld faces of two parallel rails.
Figure 8:
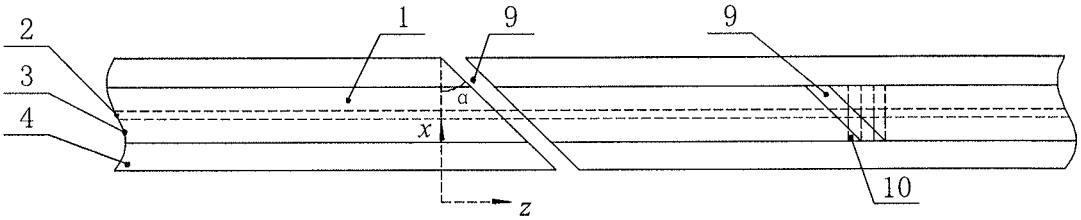
FIG. 8 is a view showing the single inclined weld face spatial structure, wherein the single inclined weld face forms an angle α with the axis x.
Figure 9:
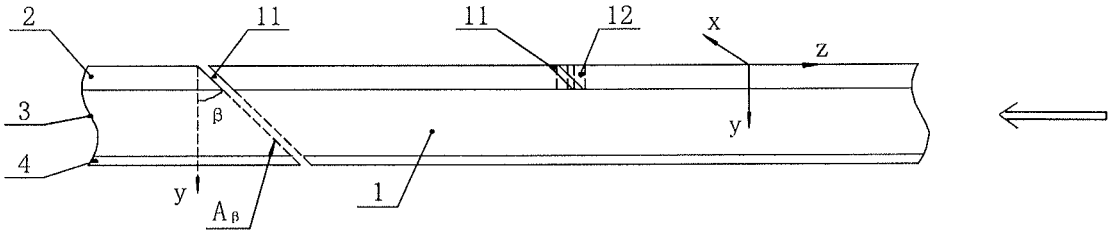
FIG. 9 is a view showing the spatial structure of the single inclined weld face, wherein the single inclined weld face forms an angle β with the axis y.

The present application includes the rail and the double inclined weld face, and two parallel rails and the double inclined weld face $A_{\alpha\beta}$ are arranged in an interleaving way, as shown in FIG. 5, the interleaving length is greater than the length of one carriage, and the welding method is the existing Aluminothermic welding.

Other Embodiments

The above mentioned embodiment may be further modified. In other embodiment of the seamless rail with the double inclined weld face structure, there is a segmental structure of the double inclined weld face and the single inclined weld face in the rail, for example the weld seams include a segmental structure with a combination of a double inclined weld face $A_{\alpha\beta}$ and a single inclined weld face, in which the single inclined weld face forms an angle $\alpha'$ with the transverse axis x at the rail waist and rail bottom, and the double inclined weld face $A_{\alpha\beta}$ includes a single inclined seam on the rail tread of rail head 2 forming an angle $\alpha$ with the axis x, and a single inclined seam on the side surface of the rail head 2 forming an angle $\beta$ with the axis y. Or a segmental inclined surface structure includes a double inclined weld face $A_{\alpha\beta}$ and a single inclined weld face forming an angle $\beta'$ with the transverse axis y at the rail waist and rail bottom, wherein the double inclined weld face $A_{\alpha\beta}$ includes a single inclined weld seam on the rail tread of rail head 2 forming an angle $\alpha$ with the axis x, and a single inclined seam on the side surface of the rail head 2 forming an angle $\beta$ with the axis y.

In addition, in other embodiment, the weld seams of rail have a segmental structure with a double inclined weld face and an another double inclined weld face, for example the weld seam includes a double inclined weld face $A_{\alpha\beta}$ with a inclined weld seam at the rail head 2 which forms an angle $\alpha$ with the axis x and a inclined weld seam at the side surface of the rail head 2 which forms an angle $\beta$ with the vertical axis y, and another double inclined weld face $A_{\alpha'\beta'}$ with a inclined weld seam which forms an angle $\alpha'$ with the axis x and a inclined weld seam which forms an angle $\beta'$ with the vertical axis y at the rail waist and rail bottom, wherein the angle $\alpha'$ is different from the angle $\alpha$, and the angle $\beta'$ is different from the angle $\beta$.

As an alternative, the weld seam of rail includes a single inclined surface $A_{\alpha'}$ at a part of the rail waist and rail bottom which forms an angle $\alpha'$ with the axis x, or the weld seam includes a single inclined weld face $A_{\beta'}$ at a part of the rail waist and rail bottom which forms an angle $\beta'$ with the vertical axis y, or includes another double inclined weld face $A_{\alpha'\beta'}$ at a part of the rail waist and rail bottom which forms an angle $\alpha'$ with the axis x and an angle $\beta'$ with the axis y, wherein the angle $\alpha'$ is different from the angle $\alpha$ and the angle $\beta'$ is different from the angle $\beta$.

The angle $\alpha'$ is defined in a range of 30°~45°, and the angle $\beta'$ is defined in a range of 30°~45°. Since a double inclined weld face $A_{\alpha\beta}$ is provided in a part of the rail weld face, and a single inclined cross section $A_{\alpha'}$, $A_{\beta'}$, or $A_{\alpha'\beta'}$ is provided in another part of the rail weld face, a step transition is formed at the intersection of the two parts, which will facilitate the position of the rail during welding, and enhance the tangential and axial bearing capacity of the weld face at the same time, and the jog up and down and leftward and rightward vibration are eliminated when the train passes through the seam of the weld face.

LIST OF REFERENCE SIGNS

1 rail
2 rail head
3 rail waist
4 rail bottom
5 an inclined weld seam formed by intersecting a double inclined weld face $A_{\alpha\beta}$ with a rail tread of the rail head
6 the wheel rim
7 an inclined weld seam formed by intersecting a double inclined weld face $A_{\alpha\beta}$ with the side surface of rail head
8 wheel rim
9 a weld seam formed by a single inclined weld face forming an angle $\alpha$ with the axis x
10 a wheel tread through the single inclined weld seam 9
11 a weld seam formed by a single inclined weld face forming an angle $\beta$ with the axis y
12 a wheel rim through the single inclined seam 11

What is claimed is:

1. A double inclined weld face structure for a jolt-and-vibration-free seamless rail which has high bearing capacity, comprising rails and weld seams, characterized in that the weld seams of the rails includes a double inclined weld face $A_{\alpha\beta}$ formed on at least one part of the rail, the spatial relation between the double inclined weld face $A_{\alpha\beta}$ and the rail (1) is that: a straight plane ABCD is a cross section $A_0$ perpendicular to a longitudinal axis z, and a inclined plane ABEG, which is a single inclined cross section $A_\alpha$, is achieved by rotating the straight plane ABCD an angle $\alpha$ about a vertical axis y, and an inclined cross section BEDH, which is a double inclined weld face $A_{\alpha\beta}$, is achieved by rotating the inclined cross section ABEG an angle $\beta$ about BE edge; the angle $\alpha$ is formed between the double inclined weld face $A_{\alpha\beta}$ and an axis x, and the angle $\beta$ is formed between the double inclined weld face $A_{\alpha\beta}$ and the vertical axis y; and wherein the weld seam of the rails includes the double inclined weld face $A_{\alpha\beta}$ formed on a rail head of the rail, and a single inclined cross section $A_{\alpha'}$, which forms an angle $\alpha'$ with the axis x, formed on a rail waist and a rail bottom of the rail.

2. The weld face structure as claimed in claim 1, characterized in that when $$\frac{\sigma_{0z}}{\tau_{0y}} = 1.5,\ \frac{\sigma_{0z}}{\tau_{0x}} = 2;$$

when $$\frac{\sigma_{0z}}{\tau_{0y}} = 2,\ \frac{\sigma_{0z}}{\tau_{0x}} = 2.2;$$

or when $$\frac{\sigma_{0z}}{\tau_{0y}} = 2.4,\ \frac{\sigma_{0z}}{\tau_{0x}} = 2.5,$$

for the double inclined weld face $A_{\alpha\beta}$, the corresponding values of corresponding the angle $\alpha$ and $\beta$ are selected from the following groups: $\alpha$=30°, $\beta$=30°; $\alpha$=30°, $\beta$=45°; $\alpha$=45°, $\beta$=30°; $\alpha$=45°, $\beta$=45°; $\alpha$=45°, $\beta$=60°; $\alpha$=60°, $\beta$=45°; $\alpha$=60°, $\beta$=30°; $\alpha$=30°, $\beta$=60°; $\alpha$=60°, $\beta$=60°; such that the maximum stress ($\Delta\tau_x$, $\Delta\tau_y$, $\Delta\sigma$) applied on the double inclined weld face $A_{\alpha\beta}$ are reduced markedly and the maximum bearing capacity ($\Delta F_x$, $\Delta F_y$, $\Delta F_z$) is enhanced, wherein the rate of decrement of the shear stress $\Delta\tau_x$ and $\Delta\tau_y$ are both greater than 100%, the reduction of the normal stress $\Delta\sigma$ is greater than 35%, and the rate of increment of the bearing capacity is greater than 77%, wherein $\sigma_{0z}$ is an allowable normal stress in z direction applied on the cross section $A_0$ perpendicular to the axis z of the rail, and $\tau_{0y}$ and $\tau_{0x}$ are allowable shear stresses in the y direction and the x direction applied on the surface $A_0$ respectively.

3. The weld face structure as claimed in claim 2, characterized in that the weld seam of the rails includes the double inclined weld face $A_{\alpha\beta}$ formed on a rail head of the rail, and a single inclined cross section $A_{\alpha'}$, which forms an angle α' with the axis x, formed on a rail waist and a rail bottom of the rail.

4. The weld face structure as claimed in claim 2, characterized in that a wheel tread and a wheel rim of a wheel contact with the rail synchronously, i.e. the wheel tread (6) is leftward and rightward overlapped with an inclined weld seam (5) of a rail tread of a rail head of the rail formed by the double inclined weld face $A_{\alpha\beta}$, the corresponding wheel rim (8) is backward and forward overlapped with an inclined seam (7) of a side surface of the rail head formed by the double inclined weld face $A_{\alpha\beta}$.

5. The weld face structure as claimed in claim 2, characterized in that the weld seam of the rails includes the double inclined weld face $A_{\alpha\beta}$ formed on a rail head of the rail, and a single inclined cross section $A_{\beta'}$, which forms an angle β' with axis x, formed on a rail waist and a rail bottom of the rail.

6. The weld face structure as claimed in claim 2, characterized in that the weld seam of the rails includes the double inclined weld face $A_{\alpha\beta}$ formed on a rail head of the rail, and an another double inclined weld face $A_{\alpha'\beta'}$, which forms an angle α' with the axis x and an angle β' with the axis y, formed on a rail waist and a rail bottom of the rail, wherein the angle α' is different from the angle α, and the angel β' is different from the angle β.

7. The weld face structure as claimed in claim 1, characterized in that the double inclined weld face $A_{\alpha\beta}$ is formed on the whole cross section of the weld seam of the rails, the double inclined weld face $A_{\alpha\beta}$ forms the angle α with the axis x and forms the angle β with the axis y, and a inclined weld seam is formed on a rail tread of a rail head of the rail by intersection between the double inclined weld face $A_{\alpha\beta}$ and the rail tread of the rail head, and a inclined weld seam is formed on a rail side surface of the rail head by intersection between the double inclined weld face $A_{\alpha\beta}$ and the rail side surface of the rail head.

8. The weld face structure as claimed in claim 1, characterized in that a wheel tread and a wheel rim of a wheel contact with the rail synchronously, i.e. the wheel tread (6) is leftward and rightward overlapped with an inclined weld seam (5) of a rail tread of a rail head of the rail formed by the double inclined weld face $A_{\alpha\beta}$, the corresponding wheel rim (8) is backward and forward overlapped with an inclined seam (7) of a side surface of the rail head formed by the double inclined weld face $A_{\alpha\beta}$.

9. The weld face structure as claimed in claim 1, characterized in that the weld seam of the rails includes the double inclined weld face $A_{\alpha\beta}$ formed on a rail head of the rail, and a single inclined cross section $A_{\beta'}$, which forms an angle β' with axis x, formed on a rail waist and a rail bottom of the rail.

10. The weld face structure as claimed in claim 1, characterized in that the weld seam of the rails includes the double inclined weld face $A_{\alpha\beta}$ formed on a rail head of the rail, and an another double inclined weld face $A_{\alpha'\beta'}$, which forms an angle α' with the axis x and an angle β' with the axis y, formed on a rail waist and a rail bottom of the rail, wherein the angle α' is different from the angle α, and the angel β' is different from the angle β.

11. A double inclined weld face structure for a jolt-and-vibration-free seamless rail with high bearing capacity as claimed in claim 1, characterized in that the double inclined weld faces of two parallel rails (1) are arranged in an interleaving way and the interleaving length is greater than the length of one carriage.

12. The weld face structure as claimed in claim 1, characterized in that the weld technique for the double inclined weld face is an Aluminothermic welding.

* * * * *